US011845280B2

(12) United States Patent
Oguma et al.

(10) Patent No.: US 11,845,280 B2
(45) Date of Patent: Dec. 19, 2023

(54) LIQUID EJECTING HEAD AND LIQUID EJECTING DEVICE

(71) Applicant: TOSHIBA TEC KABUSHIKI KAISHA, Tokyo (JP)

(72) Inventors: Makoto Oguma, Mishima Shizuoka (JP); Masashi Shimosato, Mishima Shizuoka (JP); Isao Suzuki, Mishima Shizuoka (JP); Tsubasa Konishi, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 30 days.

(21) Appl. No.: 17/746,888

(22) Filed: May 17, 2022

(65) Prior Publication Data

US 2023/0064827 A1 Mar. 2, 2023

(30) Foreign Application Priority Data

Aug. 26, 2021 (JP) ..... 2021-138364

(51) Int. Cl.

| | |
|---|---|
| ***B41J 2/145*** | (2006.01) |
| ***B41J 2/045*** | (2006.01) |
| ***B41J 2/14*** | (2006.01) |

(52) U.S. Cl.

CPC ..... *B41J 2/145* (2013.01); *B41J 2/04503* (2013.01); *B41J 2/14201* (2013.01); *B41J 2002/14491* (2013.01)

(58) Field of Classification Search

CPC .... B41J 2/145; B41J 2/04503; B41J 2/14201; B41J 2002/14491; B41J 2/14209

See application file for complete search history.

(56) References Cited

U.S. PATENT DOCUMENTS

| | | | |
|---|---|---|---|
| 8,025,368 | B2 | 9/2011 | Watanabe |
| 8,403,462 | B2 | 3/2013 | Watanabe |
| 2013/0050338 | A1 | 2/2013 | Shimosato |

FOREIGN PATENT DOCUMENTS

| | | | |
|---|---|---|---|
| JP | 2012011653 | A5 | 1/2012 |

OTHER PUBLICATIONS

Miyagi, Maskai et al., Machine Translation of "Liquid Injection Head And Liquid Injection Device", Jan. 18, 2019, [section: Ink jet head and Discharge part] [see Figs. 1-3 and 6-7] (Year: 2019).*

(Continued)

*Primary Examiner* — Lisa Solomon

(74) *Attorney, Agent, or Firm* — Kim & Stewart LLP

(57) ABSTRACT

A liquid ejecting head of a side shooter type includes a plate including a plurality of nozzles arranged along a first direction and an actuator with a plurality of pressure chambers arranged along the first direction. Each pressure chamber communicates with a corresponding one of the nozzles. The actuator further includes dummy chambers, each of which is between two otherwise adjacent pressure chambers. Common chambers are provided in the actuator. The pressure and dummy chambers are arranged between the common chambers. The end portions of the pressure chambers are connected to a common chamber. The width of the end portions of each of the pressure chambers is less than the width of a portion of the pressure chamber between the end portions.

20 Claims, 11 Drawing Sheets

(56) References Cited

OTHER PUBLICATIONS

U.S. Appl. No. 17/729,922, filed Apr. 26, 2022.
Extended European Search Report dated Dec. 14, 2022 in corresponding European Patent Application No. 22183765.1, 9 pages.

* cited by examiner

<TEST EXAMPLE 1>

<TEST EXAMPLE 2>

<TEST EXAMPLE 1>

<TEST EXAMPLE 3>

LIQUID EJECTING HEAD AND LIQUID EJECTING DEVICE

CROSS-REFERENCE TO RELATED APPLICATION

This application is based upon and claims the benefit of priority from Japanese Patent Application No. 2021-138364, filed Aug. 26, 2021, the entire contents of which are incorporated herein by reference.

FIELD

Embodiments described herein relate generally to a liquid ejecting head and a liquid ejecting device.

BACKGROUND

Recently, for ink jet heads, increasing speed or the amount of droplets ejected has become an issue. For example, a shear mode, shared-wall type ink jet head has high power and is suitable for ejecting high-viscosity ink or ejecting large droplets. The shear mode, shared-wall type ink jet head generally adopts so-called 3-cycle driving where the same drive column is shared by two pressure chambers so that one-third of the plurality of arranged pressure chambers are driven at the same. An independent drive head has also been developed. In such a drive head, one pressure chamber is driven by two independent drive columns and a dummy pressure chamber is provided on both sides of the driven pressure chamber. For example, a structure has been developed in which a large number of grooves are formed in a piezoelectric body adjacent to each other, but entrances to every other groove are blocked. That is, blocked and open grooves alternate with one another in the arrangement. The grooves can be independently driven so that grooves having an open entrance function as pressure chambers for ejecting liquid and grooves having a blocked entrance function as air chambers.

In such an ink jet head, ink is replenished from a common liquid chamber into a pressure chamber after ejecting ink droplets. At this time, overshooting occurs in the nozzle associated with the ejecting pressure chamber so that a meniscus swell occurs. As fluid resistance in the flow path from the common liquid chamber to the nozzle decreases, the amount of overshooting increases. In addition, unless this overshooting is suppressed, the meniscus will not be stable and the next ejection event must wait until the meniscus is stable or ejection characteristics will be deteriorated. Accordingly, in order to increase the speed of the ink jet head, it is required to rapidly reduce the swelling of the meniscus to ensure stable ejection characteristics for the next ejection event.

DETAILED DESCRIPTION

There is provided a liquid ejecting head capable of providing stable ejection characteristics.

In general, according to one embodiment, a liquid ejecting head of a side shooter type includes a plate including a plurality of nozzles arranged along a first direction, and an actuator. The actuator includes: a plurality of pressure chambers arranged along the first direction and each communicating with a corresponding one of the nozzles, a plurality of dummy chambers, each of which is between two of the pressure chambers that are adjacent to each other, and a plurality of common chambers between which the pressure and dummy chambers are arranged and communicating with each of the pressure chambers at end portions thereof in a second direction that intersects the first direction. A width of the end portions of each of the pressure chambers is less than a width of a first portion of said each of the pressure chambers between the end portions.

Figure 1:
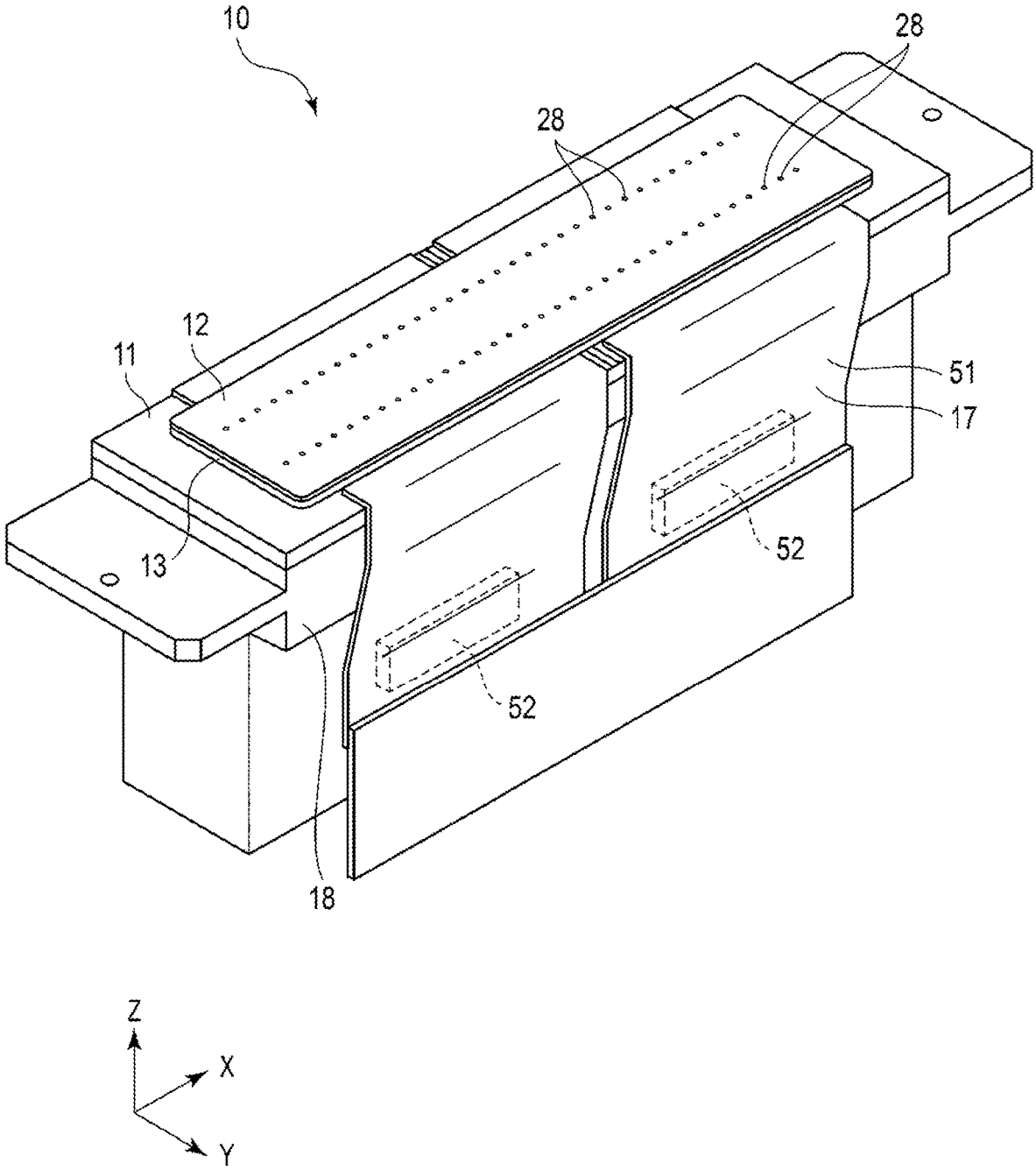
FIG. 1 is a perspective view illustrating an ink jet head according to an embodiment.
Figure 2:
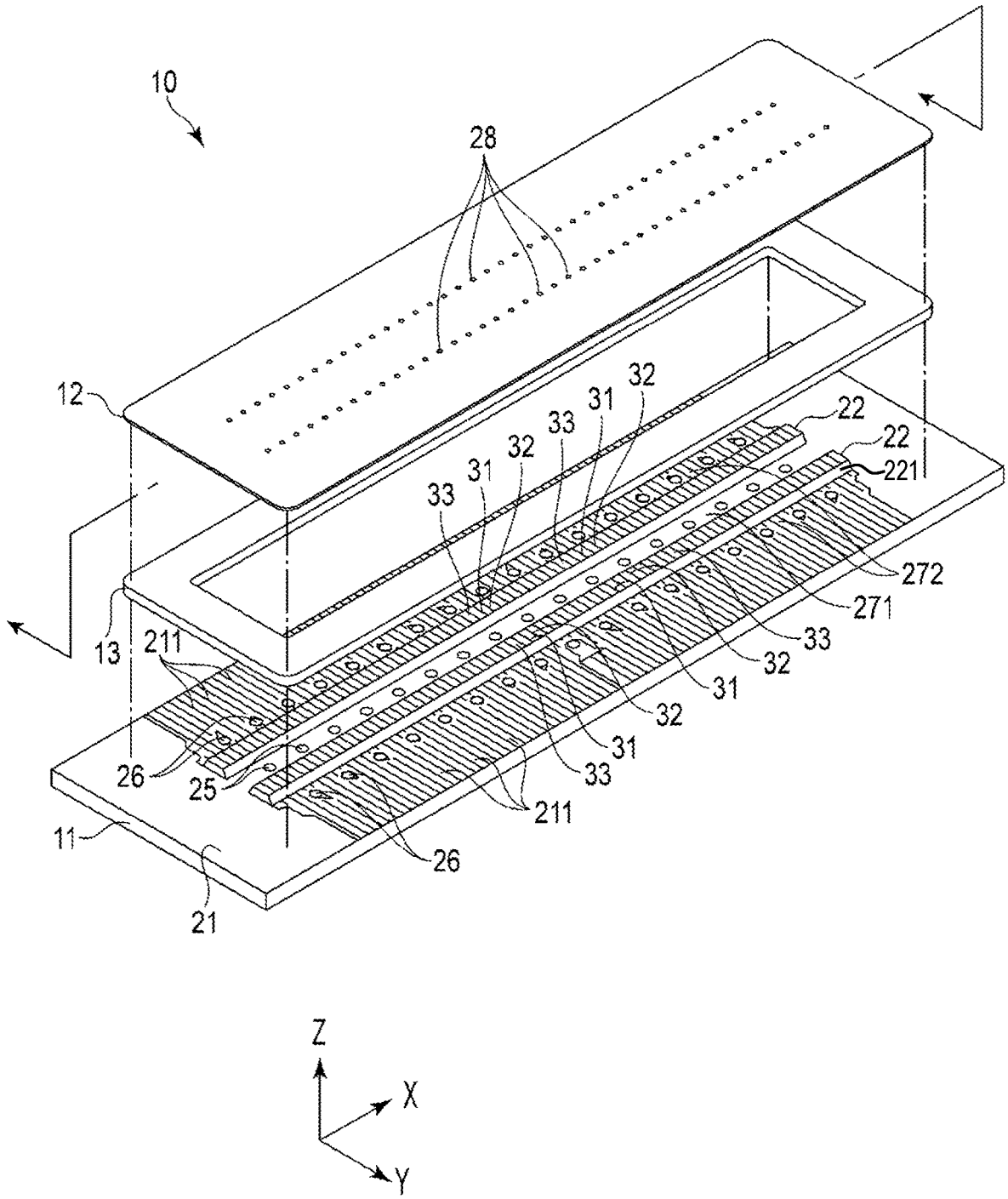
FIG. 2 is an exploded perspective view illustrating an ink jet head according to an embodiment.
Figure 3:
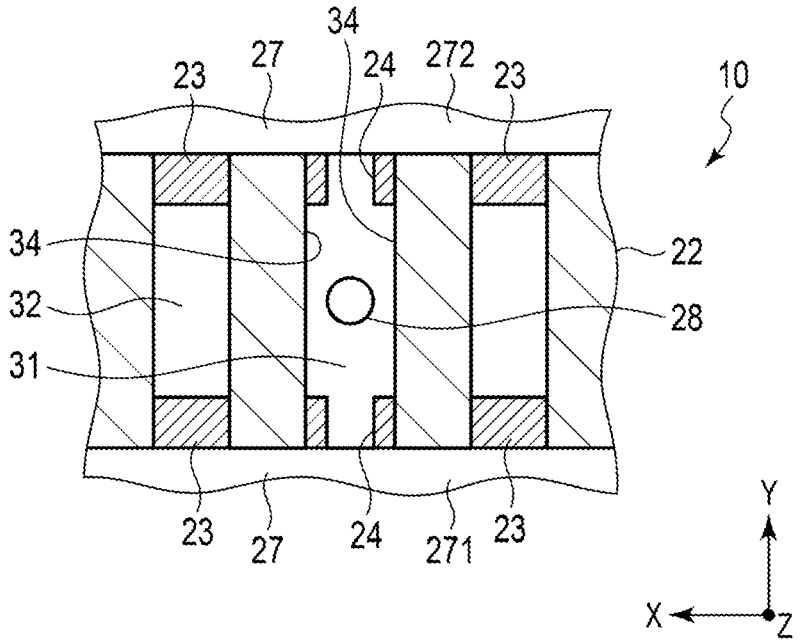
FIG. 3 is a diagram illustrating an ink jet head according to an embodiment.

Hereinafter, a configuration of an ink jet head 10 that is a liquid ejecting head will be described with reference to FIGS. 1 to 3. FIG. 1 is a perspective view illustrating the ink jet head 10 according to an embodiment, and FIG. 2 is an exploded perspective view illustrating a part of the ink jet head 10. FIG. 3 is a diagram illustrating the ink jet head 10. In the drawings, X, Y, and Z represent a first direction, a second direction, and a third direction perpendicular to each other. In this disclosure, a direction where nozzles 28 or pressure chambers 31 of the ink jet head 10 are arranged is along the X-axis, a direction in which the pressure chambers 31 extend is along the Y-axis, and a direction in which liquid is ejected is along the Z-axis.

As illustrated in FIGS. 1 to 3, the ink jet head 10 is a so-called side shooter type, shear mode, shared-wall type ink jet head. The ink jet head 10 is a device for ejecting ink and is mounted, for example, in an ink jet printer. For example, the ink jet head 10 is an independent drive type ink jet head where the pressure chambers 31 and dummy chambers 32 are alternately disposed. The dummy chambers 32 are air (empty) chambers to which ink is not supplied and do not include the nozzles 28.

The ink jet head 10 includes an actuator base 11, a nozzle plate 12, and a frame 13. In the ink jet head 10, an ink chamber 27 to which ink as an example of the liquid is supplied is formed.

The ink jet head 10 also includes components such as a circuit board 17 that controls the ink jet head 10 and a manifold 18 that forms a part of a path for liquid between the ink jet head 10 and an ink tank.

As illustrated in FIG. 2, the actuator base 11 includes a substrate 21 and a pair of actuators 22.

The substrate 21 is formed of, for example, a ceramic, such as alumina, in a rectangular plate shape. The substrate 21 includes a flat mounting surface. The pair of actuators 22 are joined to the mounting surface of the substrate 21. A plurality of supply holes 25 and discharge holes 26 are formed in the substrate 21.

As illustrated in FIG. 2, a patterned wiring 211 is formed on the substrate 21 of the actuator base 11. The patterned wiring 211 is formed of, for example, a nickel thin film. The patterned wiring 211 has a common pattern or an individual pattern and is connected to an electrode layer 34 formed in the actuators 22.

In a center portion of the substrate 21 between the pair of actuators 22, the supply holes 25 are arranged in a longitudinal direction of the actuators 22. The supply holes 25 communicate with an ink supply unit of the manifold 18. The supply holes 25 are connected to the ink tank through the ink supply unit. The ink of the ink tank is supplied to the ink chamber 27 through the supply holes 25.

The discharge holes 26 are provided in two rows with the supply holes 25 and the pair of actuators 22 interposed therebetween. The discharge holes 26 communicate with an ink discharge unit of the manifold 18. The discharge holes 26 are connected to the ink tank through the ink discharge unit. The ink of the ink chamber 27 is returned to the ink tank through the discharge holes 26.

The pair of actuators 22 are bonded to the mounting surface of the substrate 21. The pair of actuators 22 are provided in the substrate 21 along two rows with the supply holes 25 interposed therebetween. Each of the actuators 22 is formed using two plate-shaped piezoelectric bodies formed of, for example, lead zirconate titanate (PZT). The two piezoelectric bodies are bonded so that polarization directions thereof are opposite to each other with respect to a thickness direction. The actuators 22 are bonded to the mounting surface of the substrate 21 using a thermosetting epoxy adhesive. As illustrated in FIG. 2, the actuators 22 are disposed in parallel in the ink chamber 27 to correspond to the nozzles 28 arranged in two rows. The actuators 22 divide the ink chamber 27 into a first common chamber 271 where the supply holes 25 are formed and two second common chambers 272 where the discharge holes 26 are formed.

The actuators 22 are formed in a trapezoidal shape in cross-section. In a side surface portion 221 of the actuator 22, an inclined surface that is inclined in the second direction and the third direction is provided. That is, the actuator 22 is configured to have a trapezoidal shape in a cross-sectional view perpendicular to the second direction. The nozzle plate 12 is bonded to top portions of the actuators 22. The actuator 22 includes a plurality of pressure chambers 31 and a plurality of dummy chambers 32. The actuator 22 includes a plurality of side wall portions 33 and includes grooves that form the pressure chambers 31 and the dummy chambers 32 between the side wall portions 33. In other words, the side wall portions 33 are formed as drive elements between the grooves forming the pressure chambers 31 and the dummy chambers 32.

As illustrated in FIGS. 1 to 3, a bottom surface portion of the groove and a main surface of the substrate 21 are connected to each other through the inclined side surface portion 221. The pressure chambers 31 and the dummy chambers 32 are alternately disposed. The pressure chambers 31 and the dummy chambers 32 extend individually in a direction intersecting the longitudinal direction of the actuators 22, and are arranged in a first direction (in the drawings, the X-axis) that is the longitudinal direction of the actuators 22.

The shape of the pressure chambers 31 and the shape of the dummy chambers 32 may be different from each other. The side wall portions 33 are formed between the pressure chambers 31 and the dummy chambers 32, and are deformed according to a drive signal so that the volume of the pressure chambers 31 changes.

The plurality of pressure chambers 31 communicate with the plurality of nozzles 28 of the nozzle plate 12 joined to the top portions. Both end portions of the pressure chamber 31 communicate with the ink chamber 27. That is, one end portion of the pressure chamber 31 is open to the first common chamber 271 of the ink chamber 27, and the other end portion of the pressure chamber 31 is open to the second common chambers 272 of the ink chamber 27. Therefore, ink flows in from the one end portion of the pressure chamber 31 and flows out from the other end portion of the pressure chamber 31. The pressure chamber 31 includes a throttle unit 24 that is provided in the openings of both ends where flow path resistance increases. The throttle unit 24 can be formed in both the openings that communicate with the first common chamber 271 and the openings that communicate with the second common chambers 272 at both ends of the pressure chamber 31. In the throttle unit 24, the fluid resistance increases since a cross-sectional area of the flow path perpendicular to the second direction of the pressure chamber 31 is less than that of the full dimension of the inside of the pressure chamber 31. For example, at entrances of opposite ends of the pressure chamber 31, a dimension of the throttle unit 24 in a direction intersecting the second direction is less than the width dimension of the pressure chamber 31 in the first direction or the third direction. For example, by providing a wall member or a protrusion in the pressure chamber 31, the throttle unit 24 may be configured to block a part of a flow path between the pressure chamber 31 and the ink chamber 27.

However, if the fluid resistance of the throttle unit 24 is increased excessively, the replenishment of ink into the pressure chamber 31 after the ejection of ink droplets will be delayed, which inhibits any increase in speed. In addition, the swelling of the meniscus varies depending on ink viscosity, ejection volume, drive frequency, or the like. Accordingly, parameters of the throttle unit 24 such as its dimensions or position are set to obtain a flow path resistance appropriate for the ink replenishment conditions and expected characteristics of the swelling of the meniscus.

One side of the dummy chambers 32 in the third direction is blocked with the nozzle plate 12 that is joined to a top portion. In addition, the ends of the dummy chambers 32 in the second direction are blocked with cover units 23 from the first common chamber 271 and the second common chambers 272. One cover unit 23 is provided between the first common chamber 271 of the ink chamber 27 and one opening (serving as, for example, an entry) of the dummy chamber 32, and another cover unit 23 is provided between the second common chamber 272 and another opening (serving as, for example, an exit) of the dummy chamber 32. With the cover units 23, both end portions of the dummy chamber 32 are separated from the ink chamber 27. The dummy chamber 32 constitutes an air chamber into which ink does not flow.

The electrode layer 34 is provided in each of the pressure chambers 31 and each of the dummy chambers 32 of the actuator base 11. The electrode layer 34 is formed of, for example, a nickel thin film. The electrode layer 34 ranges from a bottom portion of the groove to the substrate 21 and is connected to the patterned wiring 211.

The nozzle plate 12 is formed of, for example, a polyimide rectangular film. The nozzle plate 12 faces a mounting surface of the actuator base 11. In the nozzle plate 12, the plurality of nozzles 28 that penetrate the nozzle plate 12 in the thickness direction are formed.

The number of nozzles 28 provided is the same as the number of pressure chambers 31, and each of the nozzles 28 is disposed to face a pressure chamber 31. The nozzles 28 are arranged in the first direction in two rows corresponding to the pair of actuators 22. Each of the nozzles 28 is configured in a cylindrical shape of which the axis extends in the third direction. The nozzles 28 may have a shape in which the diameter is constant along the axial length or a shape in which the diameter decreases or changes along the axial length toward the center portion or the front end portion. The nozzles 28 are disposed to face each other in intermediate portions in a direction in which the pressure chambers 31 formed in the pair of actuators 22 extend and communicate with the pressure chambers 31, respectively. The nozzles 28 are disposed one by one in the center portions of the pressure chambers 31 in the longitudinal direction.

The frame 13 is formed of, for example, a nickel alloy in a rectangular frame shape. The frame 13 is interposed between the mounting surface of the actuator base 11 and the nozzle plate 12. The frame 13 is bonded to each of the mounting surface of the actuator base 11 and the nozzle plate 12. That is, the nozzle plate 12 is attached to the actuator base 11 through the frame 13.

The manifold 18 is joined to a side of the actuator base 11 opposite to the nozzle plate 12. In the manifold 18, the ink supply unit as a flow path that communicates with the supply holes 25 or the ink discharge unit as a flow path that communicates with the discharge holes 26 is formed.

The circuit board 17 is a film carrier package (FCP). The circuit board 17 includes a flexible resin film 51 with a plurality of wirings, and an IC 52 that is connected to the plurality of wirings of the flexible resin film 51. The IC 52 is electrically connected to the electrode layer 34 through the wirings of the film 51 or the patterned wiring 211.

In the ink jet head 10, ink chamber 27 surrounded by the actuator base 11, the nozzle plate 12, and the frame 13 is formed. That is, the ink chamber 27 is formed between the actuator base 11 and the nozzle plate 12. For example, the ink chamber 27 is partitioned into three sections in the second direction by the two actuators 22, and includes the two second common chambers 272 (where the discharge holes 26 are formed) and the first common chamber 271 (where the supply holes 25 are formed). The first common chamber 271 and the second common chambers 272 communicate with the plurality of pressure chambers 31.

In the ink jet head 10, ink circulates between the ink tank and the ink chamber 27 through the supply holes 25, the pressure chambers 31, and the discharge holes 26. For example, in response to a signal input from a control circuit or a controller of an ink jet printer, the drive IC 52 applies a drive voltage to the electrode layers 34 of the pressure chambers 31 through the wirings of the film 51. As a result, a potential difference is generated between the electrode layers 34 of the pressure chambers 31 and the electrode layers 34 of the dummy chambers 32 so that the side wall portions 33 are selectively deformed in shear mode. By deforming the side wall portions 33 formed between the pressure chambers 31 and the dummy chambers 32 according to the drive signal, the volume of the pressure chambers 31 changes.

By deforming the side wall portions 33 in the shear mode, the volume of the pressure chambers 31 where the electrode layers 34 are provided increases so that the pressure decreases. As a result, ink of the ink chamber 27 flows into the pressure chambers 31.

When the volume of the pressure chambers 31 increases, the IC 52 applies a drive voltage having an opposite potential to the electrode layers 34 of the pressure chambers 31. As a result, the side wall portions 33 are deformed in shear mode, the volume of the pressure chambers 31 where the electrode layers 34 are provided decreases, and the pressure increases. As a result, the ink of the pressure chambers 31 is compressed and ejected from the nozzles 28.

Figure 13:
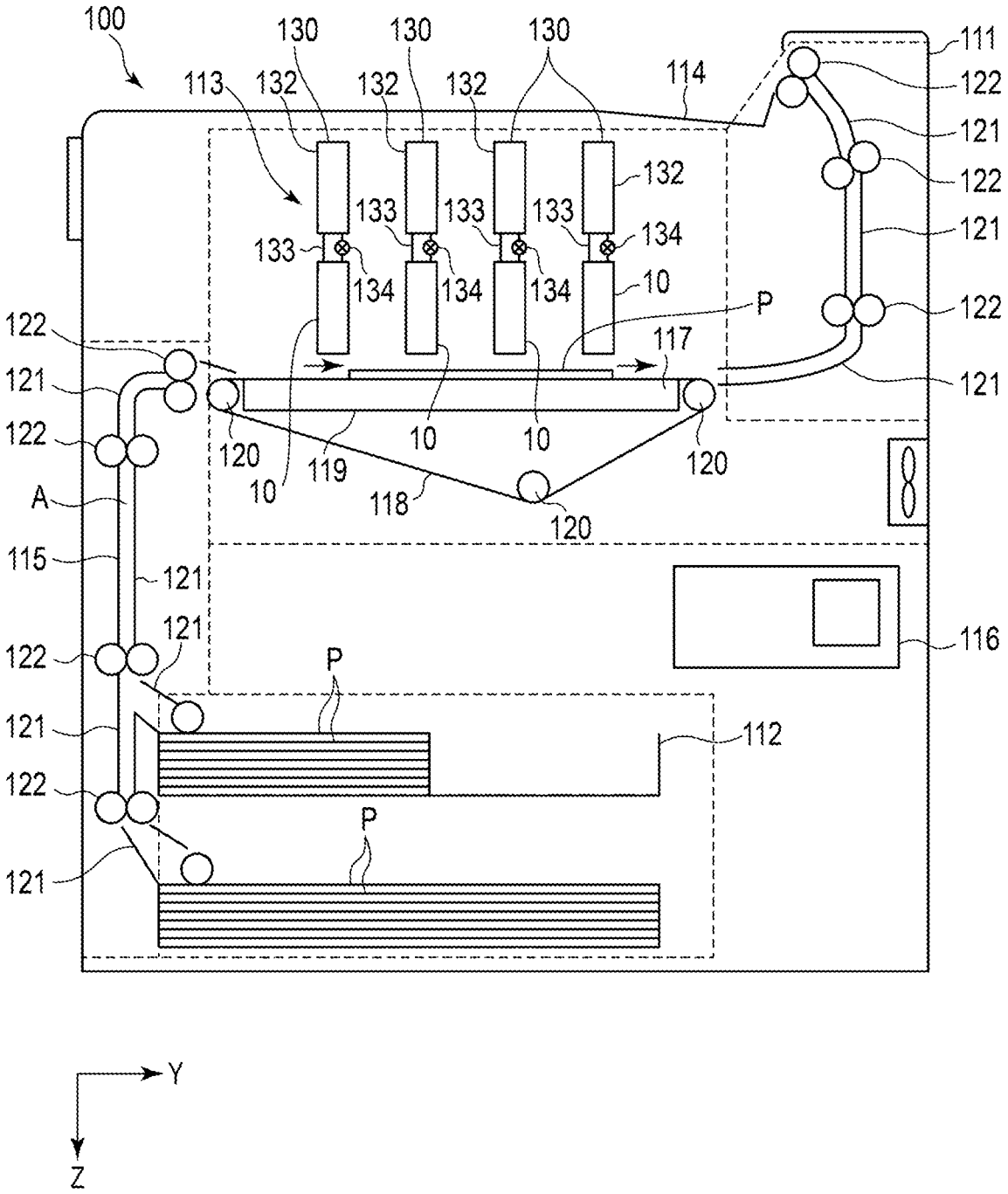
FIG. 13 is a schematic diagram illustrating an ink jet printer according to an embodiment.

An example of an ink jet printer 100 including an ink jet head 10 will be described with reference to FIG. 13. The ink jet printer 100 includes a housing 111, a medium supply tray 112, an image forming unit 113, a medium discharge tray 114, a conveyer 115 (conveying device), and a controller 116.

The ink jet printer 100 is a liquid ejecting device that performs an image forming process on, for example, paper P as a recording medium by ejecting liquid such as ink, while the paper P is conveyed along a predetermined conveyance path A from the medium supply tray 112 to the medium discharge tray 114 through the image forming unit 113.

The housing 111 houses various components of the ink jet printer 100 therein. A discharge port through which the paper P is discharged to the outside is provided at a predetermined position of the housing 111.

The medium supply tray 112 includes a plurality of paper feed cassettes and is configured to hold a plurality of sheets of the paper P having various sizes that are stacked.

The medium discharge tray 114 includes a paper discharge tray that is configured to hold the paper P that is discharged through the discharge port.

The image forming unit 113 includes: a support unit 117 that supports the paper P; and a plurality of head units 130 that are disposed to face each other above the support unit 117.

The support unit 117 includes: a conveyance belt 118 that is provided in a loop shape in a predetermined region where an image is to be formed; a support plate 119 that supports the conveyance belt 118 from the back side; and a plurality of belt rollers 120 that are provided on the back side of the conveyance belt 118.

The support unit 117 supports the paper P on the upper surface of the conveyance belt 118 during the image formation, and the conveyance belt 118 is moved by the rotation of the belt rollers 120 at a predetermined timing. As a result, the paper P is conveyed to the downstream side.

The head units 130 include: an ink jet head 10; an ink tank 132 for the ink jet head 10; a connection flow path 133 that connects the ink jet head 10 to the respective the ink tank 132; and a circulating pump 134. The head unit 130 is a circulation type head unit that circulates liquid between the ink tank 132 and the pressure chambers 31, the dummy chambers 32, and the ink chamber 27 provided in the ink jet head 10.

For example, the head units 130 for four different colors such as cyan, magenta, yellow, and black are each provided with an ink jet head 10 and ink tank 132 that contains the respective color inks. The ink tank 132 is connected to the ink jet head 10 through the connection flow path 133. The connection flow path 133 includes: a supply flow path that is connected to a supply port of the ink jet head 10 and a collection flow path that is connected to a discharge port of the ink jet head 10.

In addition, a negative pressure control device, such as a pump, is connected to the ink tank 132. The negative pressure control device controls the internal pressure of the ink tank 132 to be a negative pressure according to a water head value (hydraulic head) pressure between the ink jet head 10 and the ink tank 132. As a result, the ink supplied to each of the nozzles 28 of the ink jet head 10 is formed into a meniscus having a predetermined shape.

The circulating pump 134 is a liquid feeding pump that is, for example, a piezoelectric pump. The circulating pump 134 is provided in the supply flow path. The circulating pump 134 is connected to a drive circuit of the controller 116 through wiring, and is configured to be controllable by a processor such as a central processing unit (CPU). The circulating pump 134 circulates liquid through a circulation flow path including the ink jet head 10 and the ink tank 132.

The conveyer 115 conveys the paper P along the conveyance path A from the medium supply tray 112 to the medium discharge unit 114 through the image forming unit 113. The conveyer 115 includes: a plurality of guide plate pairs 121 that are disposed along the conveyance path A; and a plurality of conveyance rollers 122.

Each of the guide plate pairs 121 has a pair of plate members that are disposed to face each other with to the paper P to be conveyed passing therebetween, and serves to guide the paper P along the conveyance path A.

The conveyance rollers 122 are driven to rotate by the controller 116 so that the paper P is conveyed to the downstream side along the conveyance path A. A sensor that detects the conveyance status of the paper is disposed at each of positions of the conveyance path A.

The controller 116 includes: a processor such as a CPU; a read only memory (ROM) that stores various programs or the like; a random access memory (RAM) that temporarily stores various variable data or image data; and a network interface circuit that receives data input from an external device and outputs data to an external device.

In the ink jet printer 100, if the controller 116 receives a print instruction from a user operating an operation panel (or user interface) of the ink jet printer 100, the controller 116 drives the conveyer 115 to convey the paper P, and outputs a print signal to the head unit 130 at a predetermined timing to drive the ink jet head 10. In the ink jet head 10, as part of an ejection operation, a drive signal is transmitted to the IC 52 using an image signal corresponding to image data, a drive voltage is applied to the electrode layers 34 of the pressure chambers 31 through the wirings, the side wall portions 33 of the actuators 22 are selectively driven to eject ink from the nozzles 28, and an image is formed on the paper P while it is held on the conveyance belt 118. In addition, the controller 116 drives the circulating pump 134 to circulate the liquid through the circulation flow path that passes through the ink tank 132 and the ink jet head 10. As a part of a circulation operation, the circulating pump 134 is driven so that the ink in the ink tank 132 is supplied from the supply holes 25 to the first common chamber 271 of the ink chamber 27 through the ink supply unit of the manifold 18. This ink is supplied to the plurality of pressure chambers 31 and the plurality of dummy chambers 32. The ink flows into the second common chambers 272 of the ink chamber 27 through the pressure chambers 31. The ink is discharged from the discharge holes 26 to the ink tank 132 through the ink discharge unit of the manifold 18.

The described embodiment can provide a liquid ejecting head that has stable ejection characteristics. That is, since the ink jet head 10 includes the throttle unit 24 in the pressure chamber 31, the flow path resistance at the entry and the exit of the pressure chamber 31 is higher than would otherwise be the case in the pressure chamber 31 between the first common chamber 271 and the second common chambers 272. As a specific example, the cross-sectional area of the flow path of the opening portion at the first common chamber 271 side or the second common chambers 272 side is less than the cross-sectional area of the flow path of the main portion (portion between the end portions) of the pressure chambers 31. Therefore, the swelling of the meniscus during the liquid ejection in the ink jet head 10 decreases. Accordingly, the return of the meniscus becomes quicker, the influence on the ejection of the next droplet is reduced, and the ejection stability can be improved.

Figure 4A:
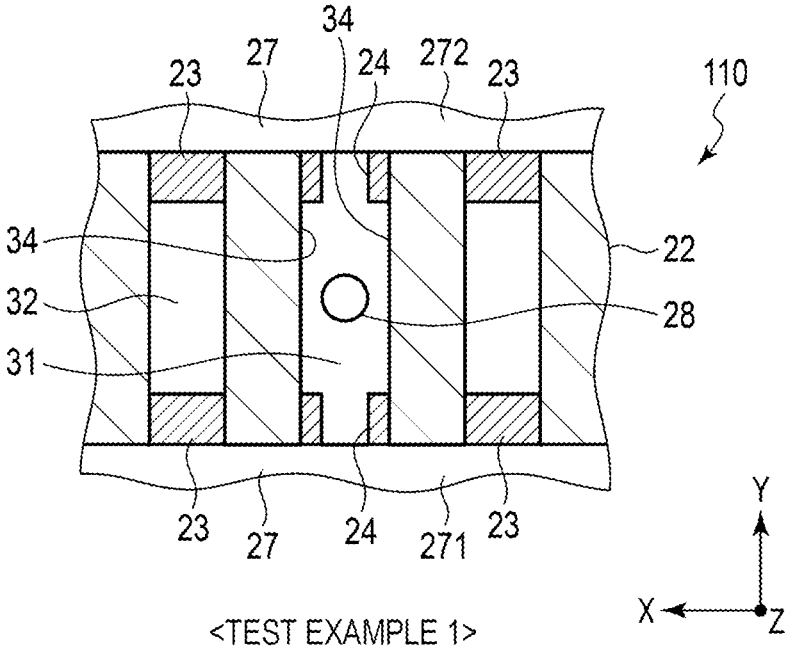
FIGS. 4A and 4B are diagrams illustrating ink jet heads according to Test Examples 1 and 2.
Figure 4B:
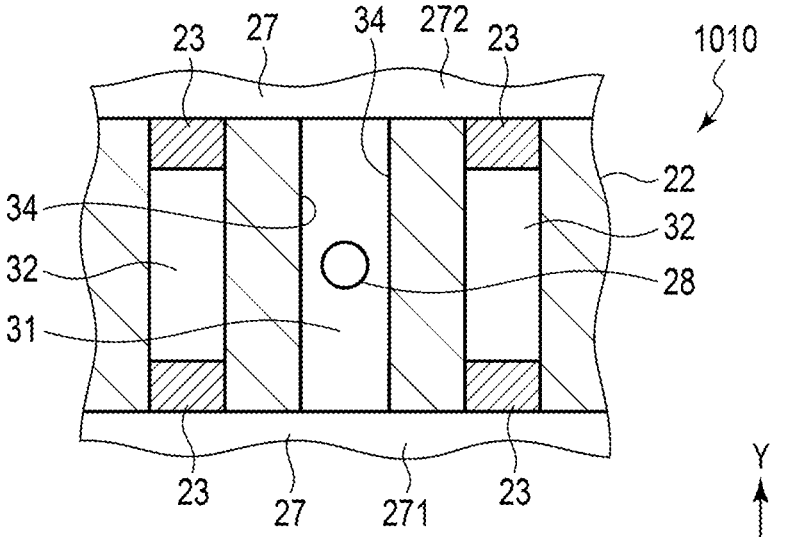
Figure 5:
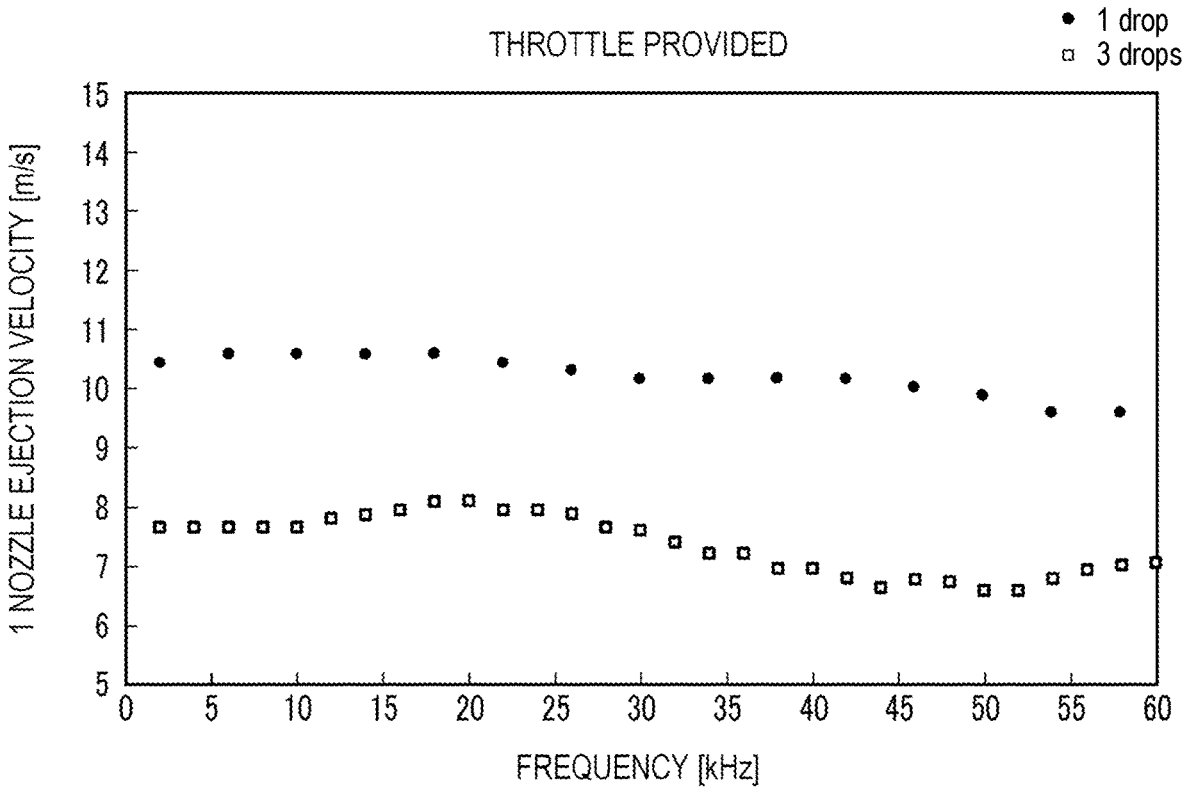
FIG. 5 is a graph illustrating an ejection velocity of an ink jet head according to Test Example 1.
Figure 6:
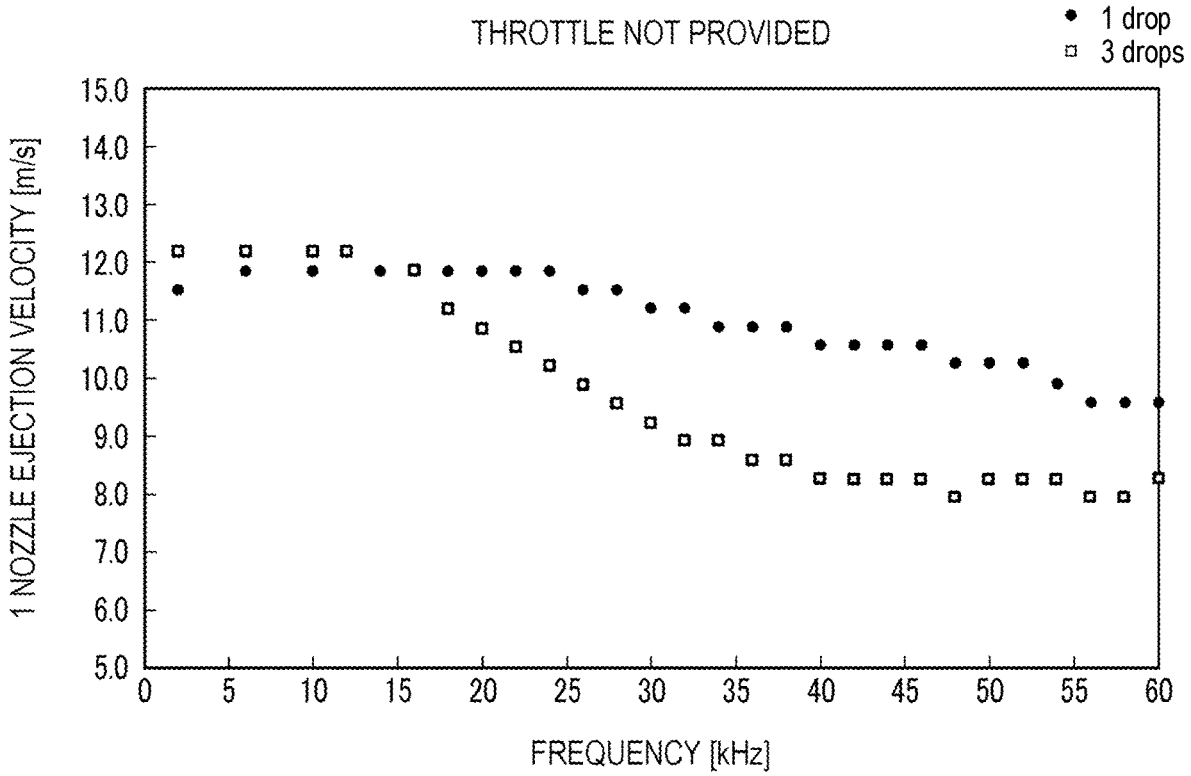
FIG. 6 is a graph illustrating an ejection velocity of an ink jet head according to Test Example 2.

FIGS. 4A and 4B illustrate Test Example 1 of an ink jet head 110 where the throttle unit 24 is provided and Test Example 2 of an ink jet head 1010 where the throttle unit 24 is not provided. FIG. 5 illustrates frequency characteristics of the ink jet head 110 according to Test Example 1 where the throttle unit 24 is provided, and FIG. 6 illustrates frequency characteristics of the ink jet head 1010 according to Test Example 2 where the throttle unit 24 is not provided. Each of FIGS. 5 and 6 illustrates a relationship between an ejection velocity from a nozzle and a frequency for 1 drop and 3 drop ejection cases.

Here, the ink jet head 110 according to Test Example 1 is a side shooter type in which both sides in the second direction in which the pressure chambers 31 extend communicate with the common chamber, and the nozzles 28 are formed in a middle portion of the pressure chambers 31 along the length of the pressure chambers.

As illustrated in FIG. 6, in the ink jet head 1010 according to Test Example 2, the ejection velocity in a low frequency band is relatively flat. However, as the frequency increases, the ejection velocity tends to decrease, and there is a difference in ejection velocity between the low frequency band and the high frequency band. In the case in which 1 drop is ejected by the ink jet head 1010 according to Test Example 2, the ejection velocity is flat up to 25 kHz. However, at 25 kHz or higher, as the frequency increases, the ejection velocity tends to decrease. In addition, in the case in which 3 drops are ejected by the ink jet head 1010 according to Test Example 2, the ejection velocity is flat up to 15 kHz. However, at 15 kHz or higher, as the frequency increases, the ejection velocity tends to decrease. Accordingly, the landing position varies depending on printing patterns. This way, if there is a difference in ejection velocity, a long period of time is required to reduce the swelling of the meniscus, which causes deterioration in printing quality. Therefore, high-speed driving cannot be achieved.

On the other hand, as illustrated in FIG. 5, in the ink jet head 110 including the throttle unit 24, the ejection velocities for both 1 drop and 3 drop ejections tend to be flat. The reason for this is that the fluid resistance from the common liquid chamber to the nozzles 28 increases so that the swelling of the meniscus is reduced.

Figure 7:
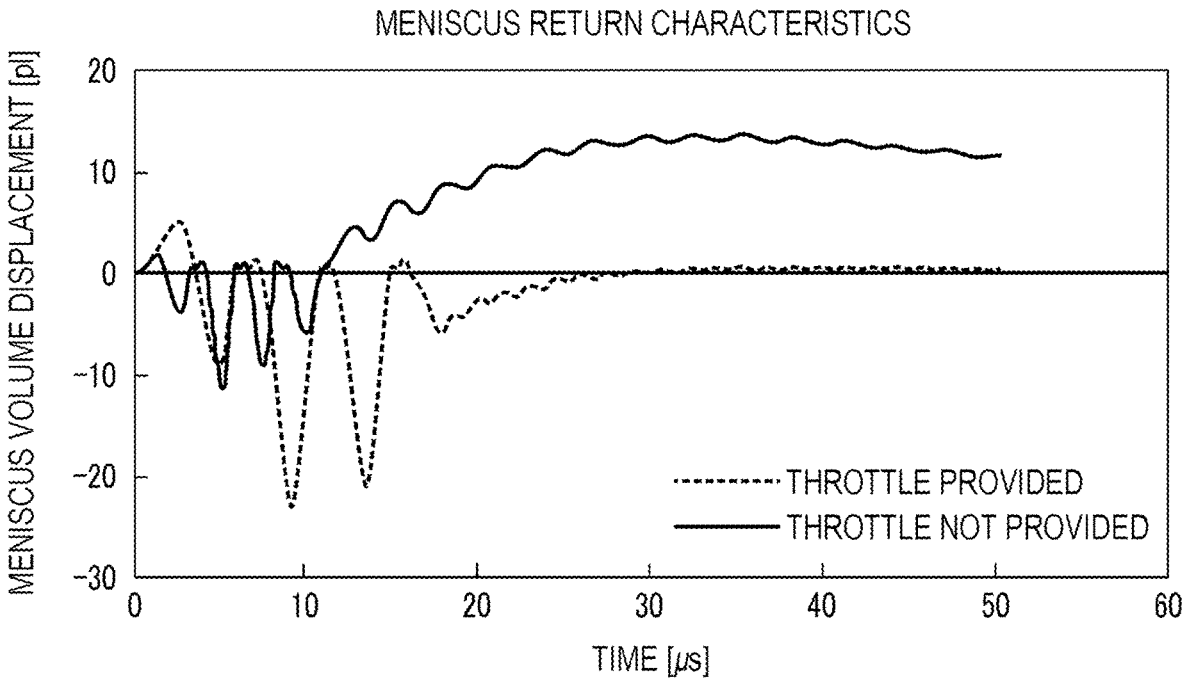
FIG. 7 is a graph illustrating meniscus return characteristics of ink jet heads according to Test Examples 1 and 2.

FIG. 7 illustrates the results of a simulation of a meniscus return for Test Example 1 (where the throttle unit 24 is provided in the pressure chamber 31) and Test Example 2 (where the throttle unit 24 is not provided in the pressure chamber 31). FIG. 7 shows the meniscus state of the nozzles 28 in a low frequency band in which there is a sufficient period of time from ejection of an ink droplet before ejection of the next ink droplet, and the ejection in a stable state after waiting for the return of the meniscus can be achieved whether or not the throttle unit 24 is provided. On the other hand, in a high frequency band, the period of time from the first droplet ejection to the next droplet is shorter, and thus the next droplet ejection starts before the complete return of the meniscus. Therefore, in the ink jet head 1010 that does not have a throttle unit 24, since the swelling of the meniscus becomes significant after the first droplet ejection, the meniscus return cannot be achieved prior to the next droplet ejection, and the ejection velocity decreases. On the other hand, if the throttle unit 24 is provided, since the swelling of the meniscus is reduced, the meniscus return becomes quicker, and the influences of the meniscus on the next droplet can be suppressed or mitigated. Accordingly, it can be said from the results of the simulation that the ejection stability of the ink jet head 110 can be improved by providing the throttle between the pressure chambers 31 and the common chamber.

Figure 8A:
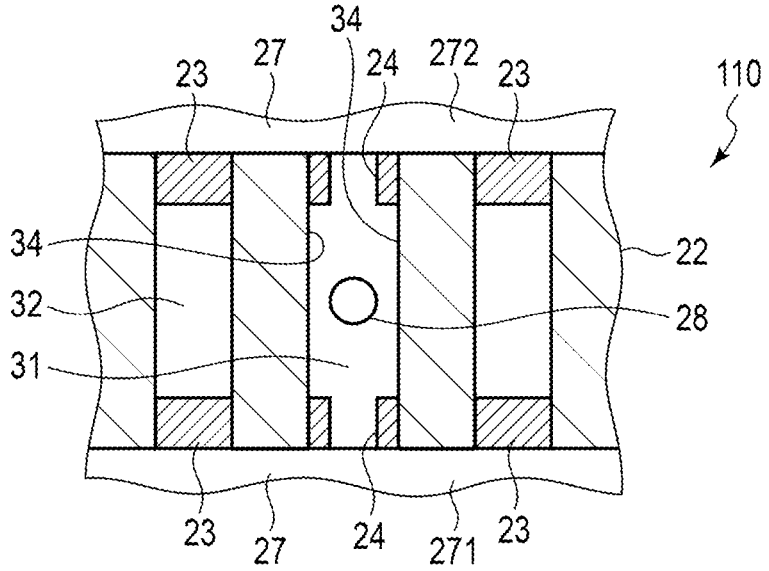
FIGS. 8A and 8B are diagrams illustrating end shooter type ink jet heads according to Test Examples 1 and 3.
Figure 8B:
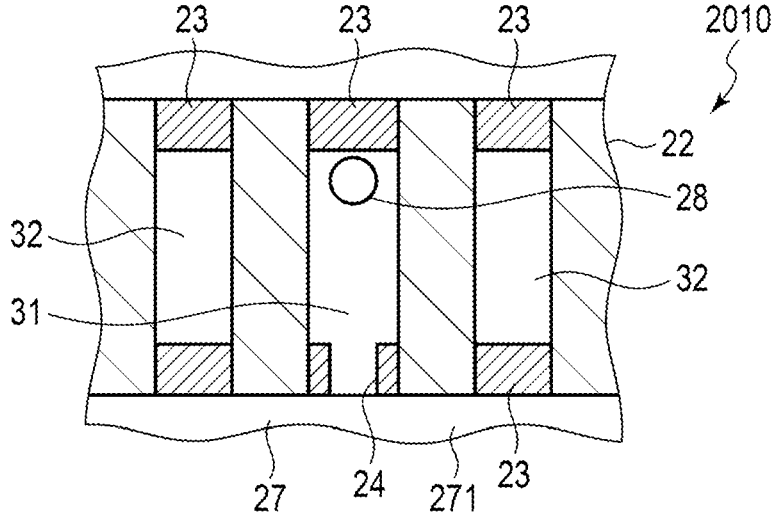

FIGS. 8A and 8B are diagrams illustrating the side shooter type ink jet head 110 according to Test Example 1 and a shear mode, shared-wall type, end shooter type ink jet head 2010 according to Test Example 3 where an ink entrance is formed at one end of a pressure chamber 31 and nozzles 28 are formed at the other end.

Figure 9:
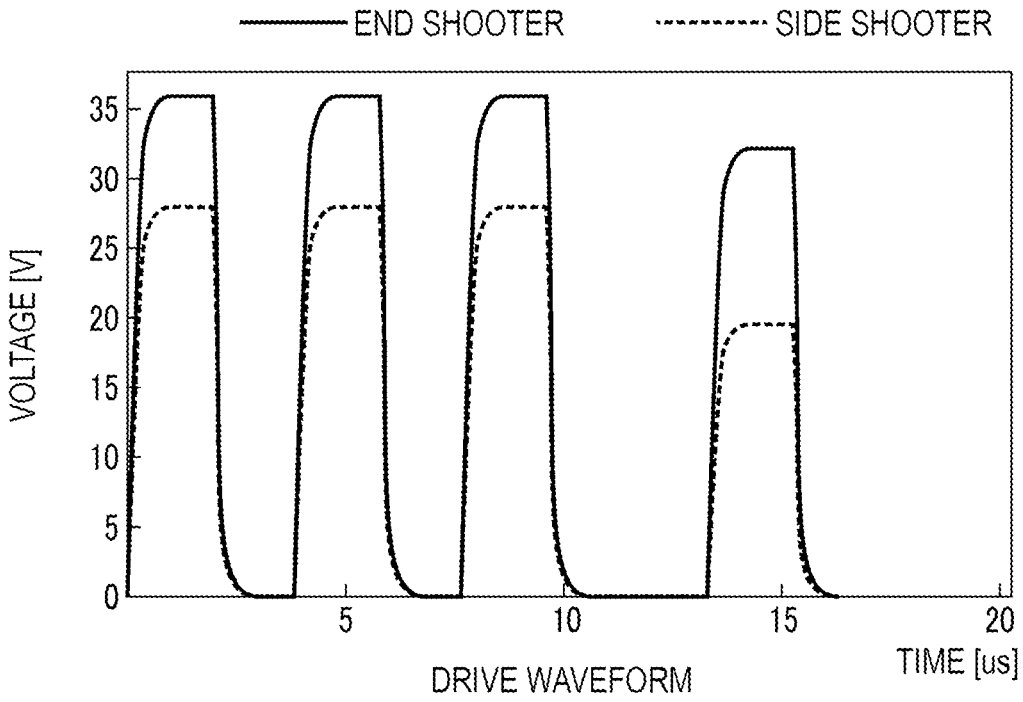
FIG. 9 is a graph illustrating drive waveforms of ink jet heads according to Test Examples 1 and 3.
Figure 10:
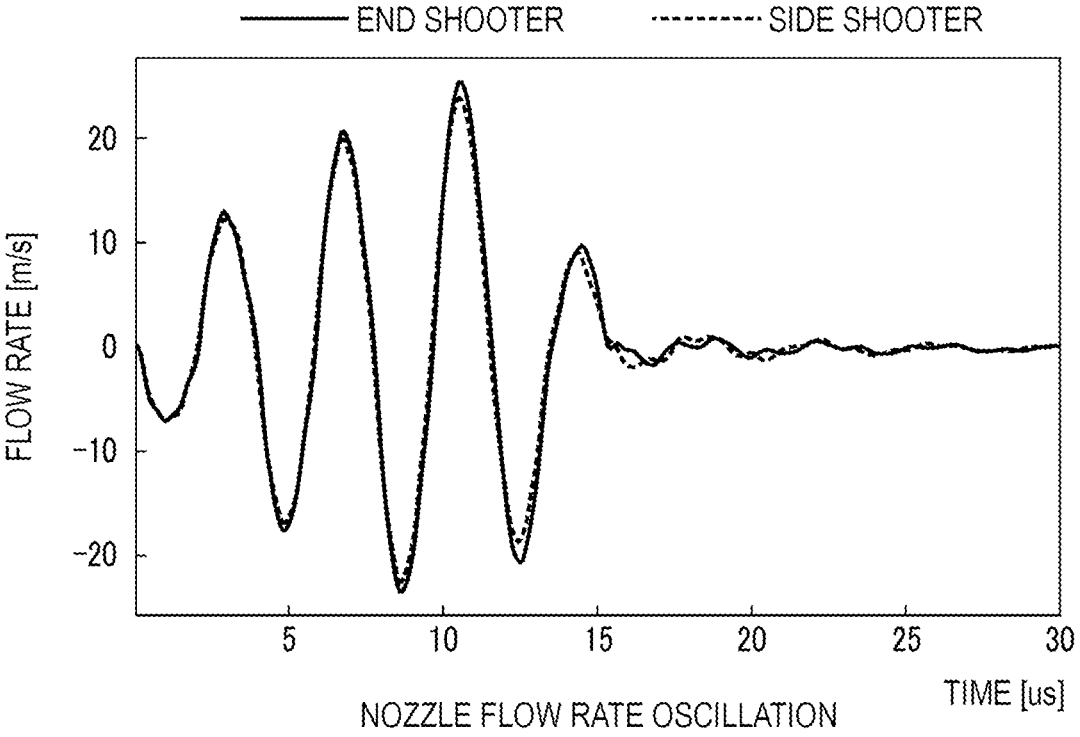
FIG. 10 is a graph illustrating nozzle flow rate oscillations of ink jet heads according to Test Examples 1 and 3.
Figure 11:
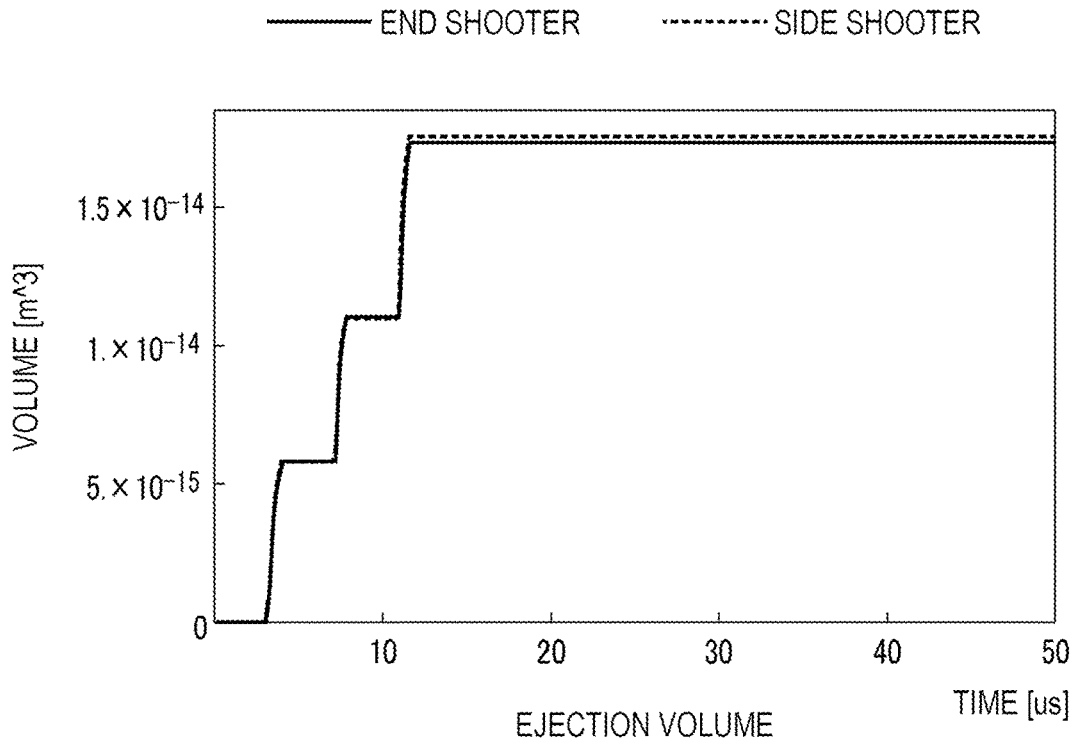
FIG. 11 is a graph illustrating ejection volumes of ink jet heads according to Test Examples 1 and 3.
Figure 12:
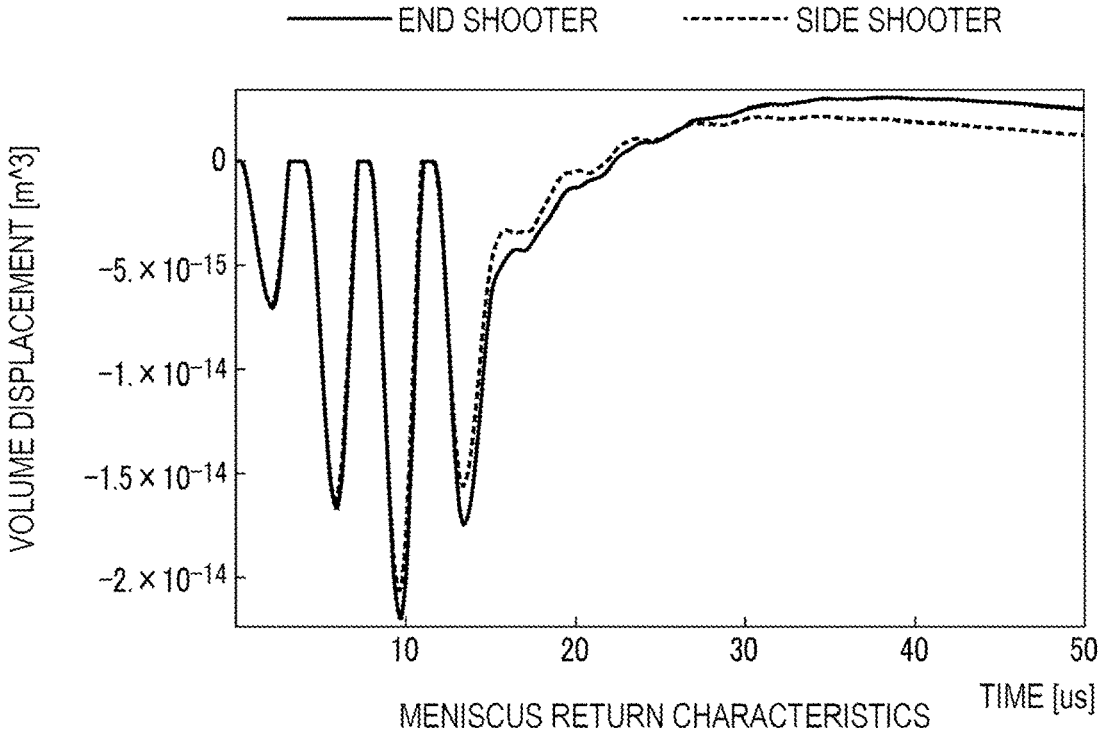
FIG. 12 is a graph illustrating meniscus return characteristics of ink jet heads according to Test Examples 1 and 3.

FIGS. 9 to 12 illustrate a comparison between simulation characteristics if the throttle unit 24 is provided in the end shooter type ink jet head 2010 (Test Example 3) and the side shooter type ink jet head 110 (Test Example 1). FIG. 9 illustrates the drive waveforms for these test examples. FIG. 10 illustrates the nozzle flow rate oscillations for these test examples. FIG. 11 illustrates the ejection volumes for these test examples. FIG. 12 illustrates the meniscus return characteristics.

The ink jet head 2010 according to Test Example 3 is an end shooter type where one end side in the second direction in which the pressure chambers 31 extend communicates with the common chamber and another end side thereof is closed so that the nozzles 28 are formed in the end portion of the flow path. That is, the ink jet head 2010 configures the flow path where ink flows from one side in the second direction to the nozzles 28.

In the end shooter type ink jet head 2010 according to Test Example 3 where ink is supplied from one side and the side shooter type ink jet head 110 according to Test Example 1 where ink is supplied from both sides, if the drive voltages are compared under the same conditions including the ejection volume, the nozzle flow rate oscillation, and the meniscus return characteristics, the drive voltage in the configuration of the side shooter type where ink is supplied from both sides is the lowest. Therefore, it can be said that the supply from both sides is superior to the supply from one side from the viewpoint of the drive efficiency. That is, the so-called side shooter type ink jet head 110 where the nozzles are provided at the center of the pressure chambers and the entrance of ink is provided at both ends has higher ejection efficiency than the end shooter type ink jet head 2010.

The present invention is not limited to the above-described examples and can be embodied in the implementation phase by modifying the components within a range not departing from the scope of the present invention.

In the above example, the actuator 22 including the plurality of grooves is disposed on the main surface portion of the substrate 21. Alternatively, the actuator 22 may be provided on an end surface of the substrate 21. In addition, the number of nozzle arrays is not limited to the above example and may be one or three or more.

In addition, in the above example, the actuator base 11 including the stacked piezoelectric body where the piezoelectric members are stacked on the substrate 21 is used. Alternatively, the actuator base 11 consisting of only the piezoelectric members without using the substrate may be formed. In addition, one piezoelectric member may be used instead of using the two piezoelectric members. In addition, the dummy chamber 32 may communicate with the first common chamber 271 or the second common chambers 272. In addition, the supply side and the discharge side may be reversed or may be configured to be switchable.

In addition, in the above example, the circulation type ink jet head is adopted in which one side of the pressure chambers 31 is the supply side, another side of the pressure chambers 31 is the discharge side, and fluid flows into one side of the pressure chambers and flows out from another side of the pressure chambers. Alternatively, the ink jet head may be, for example, a non-circulation type. In addition, for example, the common chambers on both sides of the pressure chambers 31 may be on the supply side so that liquid flows in from both sides. That is, fluid flows in from both sides of the pressure chambers 31 and flows out from the nozzles 28 disposed at the center of the pressure chambers 31. Even in such a case, by providing the throttle unit 24 in the entry portions of both sides of the pressure chambers 31, the fluid resistance increases, and the ejection efficiency can be improved.

For example, the liquid to be ejected is not limited to ink for printing. For example, a device that ejects liquid including conductive particles for forming a wiring pattern of a printed wiring board may also be adopted.

In addition, in the above example, the ink jet head 10 is used for a liquid ejecting device such as an ink jet printer. However, the ink jet head can be used for a 3D printer, an industrial manufacturing machine, or a medical use, and the size, weight and cost thereof can be reduced.

Based on the configuration described above, a liquid ejecting head capable of ensuring stable ejection characteristics can be provided.

While certain embodiments have been described, these embodiments are presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejecting head of a side shooter type, comprising:

a plate including a plurality of nozzles arranged along a first direction; and an actuator including:

a plurality of pressure chambers arranged along the first direction and each communicating with a corresponding one of the nozzles, a plurality of dummy chambers, each of which is between two of the pressure chambers that are adjacent to each other, and a plurality of common chambers between which the pressure and dummy chambers are arranged and communicating with each of the pressure chambers at end portions thereof in a second direction that intersects the first direction, wherein a width of the end portions of each of the pressure chambers is less than a width of a first portion of the pressure chamber between the end portions.

2. The liquid ejecting head according to claim 1, wherein the end portions of each of the pressure chambers include protrusions that protrude from a sidewall of the pressure chamber.

3. The liquid ejecting head according to claim 1, wherein a fluid flow path at the end portions of each of the pressure chambers is smaller in cross-sectional area than a fluid flow path in the first portion of the pressure chamber.

4. The liquid ejecting head according to claim 1, wherein the actuator includes a plurality of grooves that form the pressure and dummy chambers and a plurality of side walls that surround the grooves.

5. The liquid ejecting head according to claim 4, wherein the side walls of the pressure chambers deform upon application of a drive signal.

6. The liquid ejecting head according to claim 1, wherein each of the pressure chambers extends in the second direction, and each of the nozzles is at a position corresponding to a midpoint of the pressure chamber along the second direction.

7. The liquid ejecting head according to claim 1, wherein liquid is ejected from the nozzles in a third direction that intersects the first and second directions.

8. The liquid ejecting head according to claim 1, wherein a length of the end portions of each of the pressure chambers in the second direction is less than a length of the first portion of the pressure chamber in the second direction.

9. The liquid ejecting head according to claim 1, wherein the actuator further includes a plurality of electrode layers, each electrode layer disposed between one of the pressure chambers and one of the dummy chambers that are adjacent to each other.

10. The liquid ejecting head according to claim 1, wherein the actuator comprises a piezoelectric material.

11. A liquid ejecting device, comprising:

a conveyer configured to convey a medium along a conveyance path; and a liquid ejecting head of a side shooter type, including:

a plate including a plurality of nozzles arranged along a first direction and through which liquid is ejected towards the conveyed medium, and an actuator including:

a plurality of pressure chambers arranged along the first direction and each communicating with a corresponding one of the nozzles, a plurality of dummy chambers, each of which is between two otherwise adjacent the pressure chambers, and a plurality of common chambers between which the pressure and dummy chambers are arranged and communicating with each of the pressure chambers at end portions thereof in a second direction that intersects the first direction, wherein a width of the end portions of each of the pressure chambers is less than a width of a first portion of the pressure chamber between the end portions.

12. The liquid ejecting device according to claim 11, wherein the end portions of each of the pressure chambers include protrusions that protrude in the first direction from side walls of the pressure chamber.

13. The liquid ejecting device according to claim 11, wherein a fluid flow path cross-sectional area at the end portions of each of the pressure chambers is smaller than a fluid flow path cross-sectional area in the first portion of the pressure chamber.

14. The liquid ejecting device according to claim 11, wherein the actuator includes a plurality of grooves that form the pressure and dummy chambers and a plurality of side walls that surround the grooves.

15. The liquid ejecting device according to claim 14, wherein the side walls deform upon application of a drive signal.

16. The liquid ejecting device according to claim 11, wherein each of the pressure chambers extends in the second direction, and each of the nozzles is at a position corresponding to midpoint of the pressure chamber along the second direction.

17. The liquid ejecting device according to claim 11, wherein the liquid is ejected through the nozzles in a third direction that intersects the first and second directions.

18. The liquid ejecting device according to claim 11, wherein a length of the end portions of each of the pressure chambers in the second direction is less than a length of the first portion of the pressure chamber in the second direction.

19. The liquid ejecting device according to claim 11, wherein the actuator further includes a plurality of electrode layers each disposed between one of the pressure chambers and one of the dummy chambers that are adjacent to each other.

20. The liquid ejecting device according to claim 11, wherein the liquid includes either ink for printing or conductive particles for forming a wiring pattern.

* * * * *